United States Patent [19]

Blewitt et al.

[11] Patent Number: 4,533,893

[45] Date of Patent: Aug. 6, 1985

[54] MONOLITHIC FUSE FOR ROTATING EQUIPMENT

[75] Inventors: Donald D. Blewitt, Penn Hills; Tapan K. Gupta, Monroeville, both of Pa.

[73] Assignee: Westinghouse Electric Corp., Pittsburgh, Pa.

[21] Appl. No.: 570,489

[22] Filed: Jan. 13, 1984

[51] Int. Cl.[3] ..... H01H 85/00

[52] U.S. Cl. ..... 337/5; 337/4; 337/158; 337/293; 338/215

[58] Field of Search ..... 337/4, 5, 158, 293, 337/161, 162, 229, 273; 338/215; 361/2, 104

[56] References Cited

U.S. PATENT DOCUMENTS 3,445,798 5/1969 Lohrmann ..... 337/166

4,388,603 6/1983 Hassler et al. ..... 337/158

*Primary Examiner*—Harold Broome

*Attorney, Agent, or Firm*—L. P. Johns

[57] ABSTRACT

There is provided a current limiting fuse having a uniform and supported element with arc voltage controlling and shaping capabilities that can withstand high mechanical and electrical stress.

6 Claims, 4 Drawing Figures

MONOLITHIC FUSE FOR ROTATING EQUIPMENT

CROSS-REFERENCE TO RELATED APPLICATIONS

This application is related to the application Ser. No. 569,053, filed Jan. 9, 1984.

BACKGROUND OF THE INVENTION

1. Field of the Invention

This invention relates generally to current limiting fuses and more particularly to fuses having means for shaping and controlling the arc voltage developed by the fuse during high current interruptions.

2. Description of the Prior Art

Current limiting fuses presently employed in rotating rectifier equipment are routinely subjected to a variety of mechanical and electrical stresses during normal operation. These stresses operate on the notched portion of the fuse element in such a way as to cause premature and undesirable opening of the fuse, resulting in loss of service and possible expensive equipment failures. It would, therefore, be desirable to eliminate the notches or restricted areas from fusible elements of fuses operating in this equipment. Notches are conventionally provided in the fuse element of current limiting fuses to control and limit the fuse arc voltage generated during fault current interruption. Elements of uniform cross section, such as wires, unnotched strips and the like, lack this control feature and are capable of generating arc voltages high enough to cause insulation failures in associated equipment.

From an interruption standpoint, the ideal arc voltage shape would be rectangular. That is, it would instantaneously rise to a fixed, predetermined level and remain there until current extinction was assured, at which time it would then drop to zero.

It would be desirable if a fuse design were available that exhibited the arc voltage control characteristics of the traditional notched fuse element design and were capable of withstanding the mechanical and electrical stresses associated with rotating rectifier equipment by the use of rigidly supported uniform fusible elements.

SUMMARY OF THE INVENTION

There is provided by this invention a fuse design which absolutely controls and shapes the arc voltage characteristic by means of a non-linear resistor electrically connected in parallel with the fusible element. The fuse element is metallurgically deposited on the surface of the non-linear resistor to form a strong monolithic structure capable of withstanding the forces associated with rotating equipment. The non-linear resistor may be any of a number of ceramic-like voltage limiting devices such as silicon carbide or zinc oxide.

DESCRIPTION OF THE PREFERRED EMBODIMENT

Figure 1:
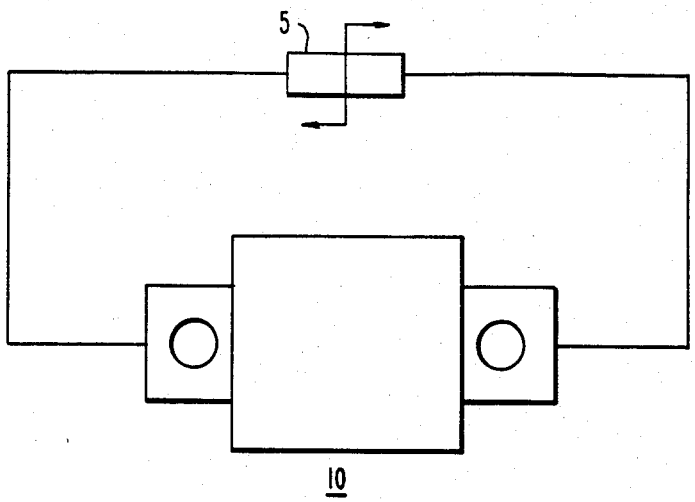
FIG. 1 is a schematical representation of a high voltage fuse utilizing a non-linear resistor element.

Referring to FIG. 1, a schematical representation of the current limiting fuse having a non-linear resistor element in parallel is shown. The fuse element is metallurgically deposited on a voltage limiting device such as silicon carbide or zinc oxide. Zinc oxide has the most satisfactory non-linear resistor characteristics based upon present technology and is, therefore, the preferred choice. Zinc oxide may be fabricated in a variety of shapes and formulations to suit the fuse application.

Figure 2A:
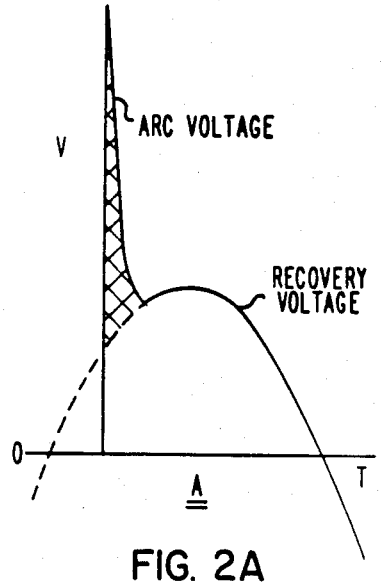
FIG. 2A is an arc voltage wave shape for a current limiting fuse without the controlled arc voltage characteristic.
Figure 2B:
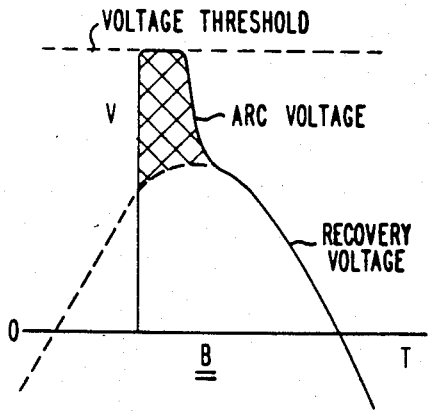
FIG. 2B is an arc voltage wave shape using a non-linear resistor element to control and shape the arc voltage.

According to the principles of this invention, FIG. 2 illustrates the operation of the current limiting fuse. The high fault arc voltage typical of a contemporary uniform element fuse is represented at FIG. 2A. The arc voltage shape expected from the same fuse with an appropriately sized non-linear resistor across it is given at FIG. 2B. It can be readily seen that one effect of the non-linear resistor is to act as a voltage clamp to limit the magnitude of the arc voltage. What is not apparent, however, is the mechanism responsible for extending the voltage out in time to approximate the ideal rectangular shape. It can be shown that the volt seconds applied to the circuit by the source during the time between fault inception and fuse melting is equal to the net volt seconds appearing across the fuse during arcing, provided that energy supplied by the source during the arcing phase is neglected. Stated another way, energy stored in the circuit during melting must be absorbed by the fuse during arcing. Neglecting source energy supplied during arcing merely establishes a minimum value for the volt seconds. The arcing volt seconds is shown by the cross-hatched areas in the Figures under the arc voltage curve. Based on the relationships given, the arcing volt second area for FIG. 2A must necessarily be equal to the arcing volt second area of FIG. 2B. Because of the voltage clamping effect of the non-linear resistor in FIG. 2B, the only way the areas will be equal is for the arc voltage to be extended in time as shown.

A current limiting fuse, as a circuit interrupter, is a passive device in that it supplies no external energy to effect current interruption. Interruption, at high fault levels, is achieved by using the circuit energy stored during the melting phase to generate an arc voltage which opposes and limits the fault current. For similar fuses, the stored energy available for interruption should be the same. It follows that the fuse which utilizes the fixed amount of stored energy in the most efficient manner will achieve the best interruption. On this basis, this invention should have superior interrupting ability since the stored circuit energy is used to generate an optimized arc voltage instead of one which is needlessly too high, and consequently collapses prematurely. In applying a zinc oxide non-linear resistor for use with a particular current limiting fuse design, the limiting or clamping voltage level would be adjusted to approximately twice the peak voltage rating of the fuse by controlling the length of the zinc oxide cylinder or by adjusting the chemical composition or treatment parameters of the zinc oxide compound itself. This insures that the peak arc voltage would be within limits imposed by appropriate standards, and yet is high enough such that the leakage current through the non-linear resistor element when the fuse has opened would be very small. The diameter of the non-linear resistor would depend upon the current rating of the fuse. The limiting action of the non-linear resistor arises because it temporarily shunts current when the threshold voltage is exceeded. Higher current ratings will have higher values of let-through current during interruption, and the non-linear resistor must be sized to accommodate them.

Figure 3:
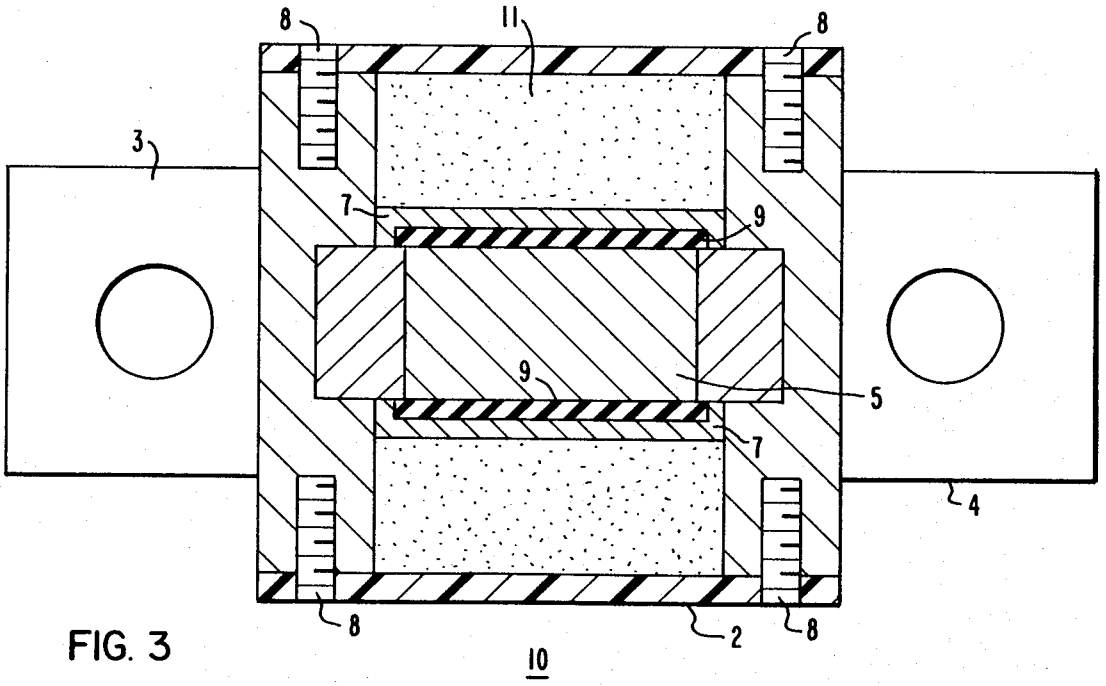
FIG. 3 is a partial cross-sectional view of a current limiting fuse incorporating the principles of this invention.

Referring to FIG. 3, there is shown a current limiting fuse 10 incorporating the principles of this invention. The current limiting fuse 10 is generally comprised of an insulating fuse barrel 2 sealed by end terminals 3 and 4. A zinc oxide non-linear resistor element 5 is located in the center of the fuse barrel and electrically connected to the end terminals 3 and 4. Pins such as 8 secure the terminals 3 and 4 to the fuse barrel 2. A uniform layer of suitable fuse element metal 7 such as silver or copper is attached and adhered to the outer surface of the non-linear resistor element by vapor deposition, spraying, painting, sputtering, or film sintering. The ends of the deposited element 7 are electrically connected to the terminals 3 and 4. In contrast to directly depositing the fuse element on the zinc oxide core, an insulating intermediate layer, such as a thin ceramic coating, may be applied first. Depositing the fuse element on the insulating intermediate layer 9 may be required to match the thermal coefficients of expansion of the fuse element and the zinc oxide core. The intermediate layer also insulates the zinc oxide core from the hot temperatures generated by the melting and arcing fuse element. The interior of the fuse is filled with a suitable filler material such as silica quartz sand 11 to aid in absorbing the heat and extinguishing arcs generated during opening of the fuse.

From the foregoing, it can be readily seen that there is provided by this invention a novel fuse construction incorporating the characteristics of a non-linear resistor that applies a predetermined threshold and an optimized shape to the arc voltage generated by the uniform supported element and which is suitable for high mechanical and electrical stress applications such as those encountered in rotating rectifier equipment.

Although there has been illustrated and described specific structures, it is to be clearly understood that the same were merely for purposes of illustration and that changes and modifications may be readily made therein by those skilled in the art without departing from the scope of this invention.

We claim:

1. A fuse, comprising:

(a) an insulating fuse housing;

(b) electrically conductive terminal means disposed at both ends of said fuse housing for sealing the ends thereof;

(c) a non-linear resistor means is electrically connected to and extends continuously between the electrically conductive terminal means within said insulating fuse housing for limiting and shaping the arc voltage developed during current interruption; and (d) a fuse element electrically connected between the electrically conductive terminal means and metallurgically deposited on the non-linear resistor means within the insulating fuse housing.

2. A fuse as recited in claim 1 wherein the non-linear resistor means is generally comprised of a formulation of zinc oxide.

3. A fuse as recited in claim 1 wherein the non-linear resistor means is covered with an insulating intermediate layer prior to metallurgical deposition of the fuse element.

4. A fuse as recited in claim 1 wherein the fuse element generally consists of silver.

5. A fuse as recited in claim 3 wherein the insulating intermediate layer generally consists of a thin ceramic coating.

6. The fuse as recited in claim 1 wherein the insulated fuse housing is filled with slica sand.

* * * * *